US005507332A

United States Patent [19]

McKinnon

[11] Patent Number: 5,507,332

[45] Date of Patent: Apr. 16, 1996

[54] RAIN COVER FOR GOLF BAG

[76] Inventor: Michael D. McKinnon, 5357 Vista Del Dios, Rancho Santa Fe, Calif. 92067

[21] Appl. No.: 358,816

[22] Filed: Dec. 19, 1994

[51] Int. Cl.[6] ..... A63B 55/00

[52] U.S. Cl. ..... 150/159; 206/315.4

[58] Field of Search ..... 150/159, 160; 135/16, 25.41; 206/315.4, 315.3, 315.5

[56] References Cited

U.S. PATENT DOCUMENTS

| | | | |
|---|---|---|---|
| 2,747,637 | 5/1956 | Brown | 150/159 |
| 2,907,364 | 10/1959 | Trenery | 150/159 |
| 2,985,212 | 8/1960 | Dozier | 150/52 |
| 3,288,189 | 11/1966 | Davis | 150/159 |
| 3,620,276 | 11/1971 | Taylor | 150/52 G |
| 3,913,648 | 10/1975 | Sessler | 150/159 X |
| 3,977,451 | 8/1976 | Duba | 150/1.5 R |
| 4,249,586 | 2/1981 | Setani | 206/315.4 |
| 4,498,579 | 2/1985 | Brick | 206/315.4 |
| 4,522,300 | 6/1985 | Hamblet | 206/315.4 |
| 4,699,164 | 10/1987 | Pilney et al. | 135/16 |
| 4,752,004 | 6/1988 | Very | 206/315.4 |
| 4,788,996 | 12/1988 | Forshee | 135/16 |
| 4,953,768 | 9/1990 | Muse | 150/159 X |
| 5,005,623 | 4/1991 | Webster, Jr. | 150/159 |
| 5,024,259 | 6/1991 | Treadway | 150/159 |
| 5,025,819 | 6/1991 | Taylor | 135/16 |
| 5,058,642 | 10/1991 | Tuntland | 150/159 |
| 5,131,442 | 7/1992 | Bevier | 150/159 |
| 5,146,967 | 9/1992 | Chapman | 150/159 |
| 5,220,950 | 6/1993 | Cordasco | 150/159 |
| 5,226,464 | 7/1993 | Solov | 150/159 |
| 5,280,798 | 1/1994 | Helm | 135/16 |
| 5,353,977 | 10/1994 | Schiro, Jr. et al. | 135/16 X |
| 5,383,505 | 1/1995 | Cordasco, Jr. | 150/159 |
| 5,390,717 | 2/1995 | Schenker et al. | 150/159 |

*Primary Examiner*—Sue A. Weaver
*Attorney, Agent, or Firm*—Calif Tervo

[57] ABSTRACT

A rain cover (10) for a golf bag (80) comprises a belt (20) adapted for attachment around the club-receiving opening (85) of a golf bag (80), a pocket (40) attached to the belt (20), a hood (60) and a skirt (70). The hood (60) is made of collapsible waterproof material and is manipulable from a stored position within the pocket (40) to a deployed position substantially completely enveloping the club receiving opening (85) and any clubs (99) contained therein. The skirt (70) is made of collapsible waterproof material and is manipulable from a stored position within the pocket (70) to a deployed position substantially completely enveloping the golf bag body (82). The belt (20) includes snap fasteners (36) slidingly attached to the belt (20) for mating attachment with snap fasteners (86) of the bag (80).

21 Claims, 3 Drawing Sheets

RAIN COVER FOR GOLF BAG

BACKGROUND OF THE INVENTION

1. Field of the Invention

This invention relates to a rain cover for a golf bag and clubs and more particularly to a rain cover that is attached around the golf bag for instant deployment.

2. Background of the Invention

It is desirable to protect a golf bag and clubs from rain, sand, dust, wet grass, mud and dirt. Various protective devices have been invented that are partially or fully directed toward this end. Many of these devices, such as U.S. Pat. No. 5,131,442 to Bevier, dust cover the clubs and offer little protection to the bag. Other devices, such as U.S. Pat. No. 5,220,950 to Cordasco, cover the entire bag and clubs but are not conveniently used. Such a cover must be stored in a pocket of the golf bag and occupies storage space. Because the cover is not easily deployed to cover the bag, there is a reluctance on the part of the golfer to use the cover.

Therefore, there has been a need for a rain cover for a golf bag that significantly protects the bag and clubs and yet is easily used.

SUMMARY OF THE INVENTION

According to the invention, a rain cover for a golf bag comprises a belt adapted for attachment around the club-receiving opening of a golf bag, a pocket attached to the belt, a hood and a skirt. The hood is made of collapsible water-resistant or waterproof material and is manipulable from a stored position within the pocket to a deployed position substantially completely enveloping the club receiving opening and any clubs contained therein. The skirt is made of collapsible water-resistant waterproof material and is manipulable from a stored position within the pocket to a deployed position substantially completely enveloping the golf bag body.

In a preferred embodiment of the invention, the rain cover is for a golf bag having a plurality of snap fasteners circumferentially spaced adjacent the club receiving opening and the cover further includes a plurality of belt snap fasteners for mating attachment with the snap fasteners of the bag. The belt snap fasteners are slidingly attached to the belt such that their spacing is adaptable to the spacing of the bag snap fasteners. The pocket is disposed substantially along the length of the belt and comprises an upper chamber for storing the hood and a lower chamber for storing the skirt.

Other features and many attendant advantages of the invention will become more apparent upon a reading of the following detailed description together with the drawings in which like reference numerals refer to like parts throughout.

DETAILED DESCRIPTION OF THE PREFERRED EMBODIMENT

Figure 1:
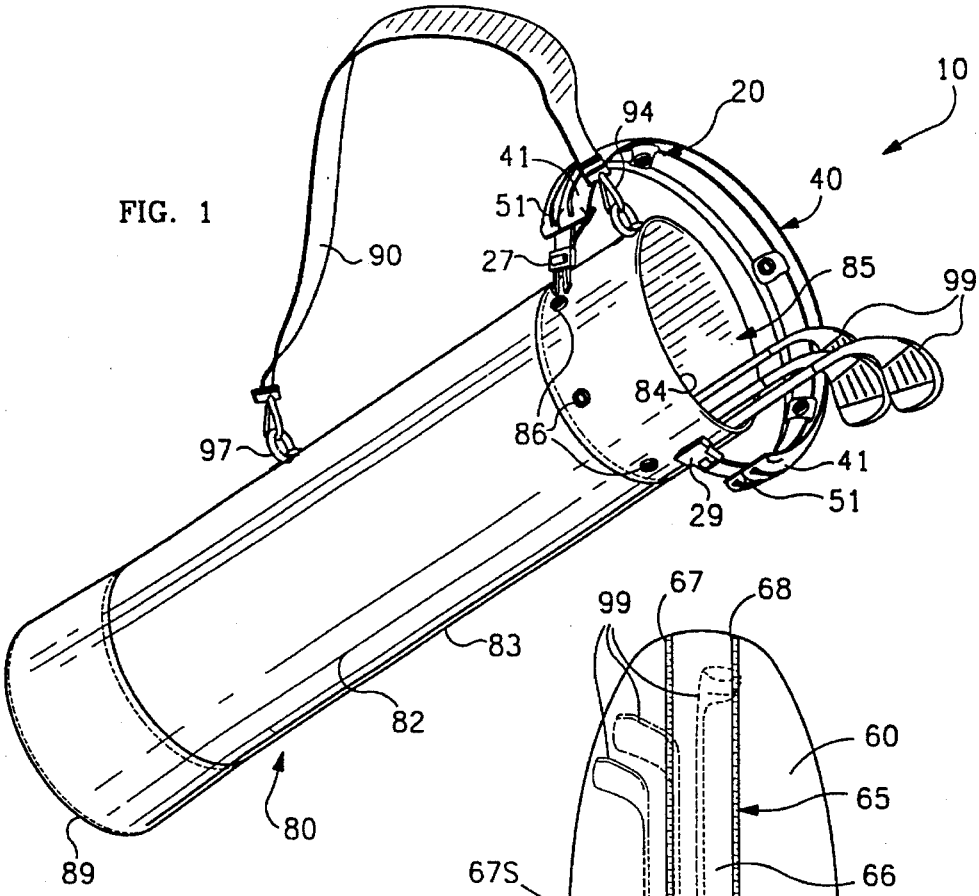
FIG. 1 is a perspective view of a preferred embodiment of the rain cover of the invention in the storage configuration and shown in position for attachment to a golf bag.
Figure 2:
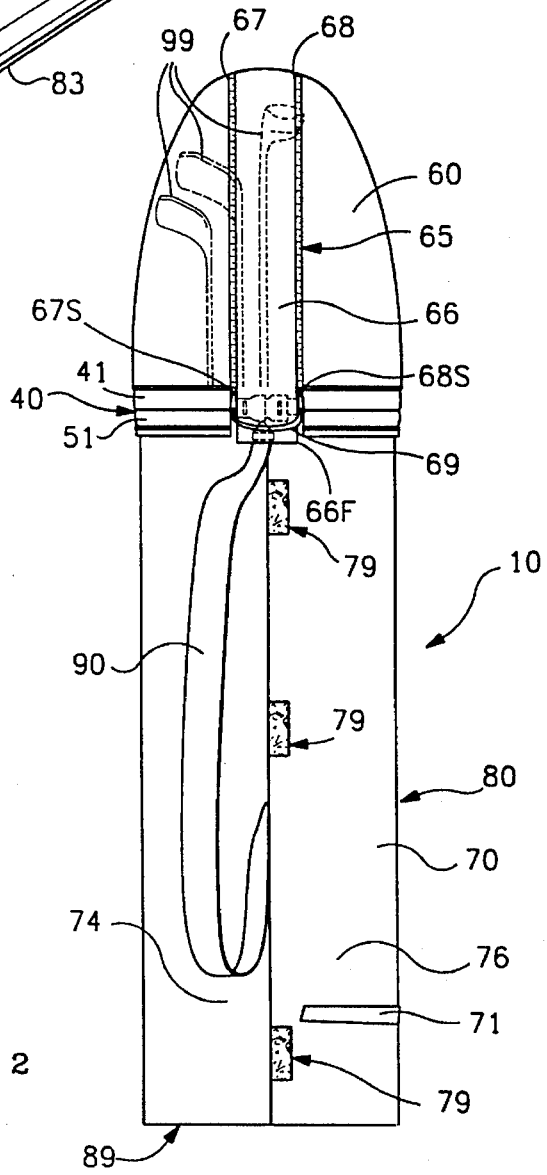
FIG. 2 is a front plan view of the cover of FIG. 1 deployed to cover the golf bag.

With reference now to drawings, and more particularly to FIGS. 1 and 2 thereof, there is shown a preferred embodiment of the rain cover, denoted generally as 10, of the invention as used to cover a golf bag, denoted generally as 80. FIG. 1 is a perspective view of rain cover 10 in the storage configuration and shown in position for attachment to golf bag 80. FIG. 2 is a front plan view of cover 10 of FIG. 1 with hood 60 and skirt 70 deployed to cover golf bag body 82.

Golf bag 80 generally comprises a cylindrical body 82 having outside 83, an enclosed bottom 89 and a top end 84 including a club receiving opening 85. Clubs 99 are inserted, handle down, into receiving opening 85 such that the club heads extend above bag top end 84. A plurality of bag snap fasteners 86, each generally the stem or male member, are located on outside 83 of bag body 82 adjacent club receiving opening 85. Snaps 86 are intended for attachment of various accessories to bag 80 and the exact location and spacing of snaps 86 varies with each bag and/or bag manufacturer. Typically, bag snaps 86 approximately form a circle circumferentially on body 82. A carrying strap 90 includes a top end 94, attached to bag 80 near top end 84, and a bottom end 97, typically attached toward the middle of bag body 82.

As seen in FIG. 1, cover 10 generally comprises a belt 20, a pocket, denoted generally as 40, attached to belt 20 and a plurality of belt snap fasteners 36 attached to belt 20 for mating attachment with bag snap fasteners 86. Belt 20 is adapted for attachment around body 82 near club-receiving opening 85 and includes a belt length adjustment and buckling means, such as snap buckles 27 at each end, for snugly releasingly attaching belt 20 around bag body 82. Other length adjustment and fastening means, such as an elastic cord, could also be used instead of buckles 29. In the preferred embodiment shown, buckles 27 would be fastened under top end 94 of carrying strap 90.

Pocket 40 is disposed substantially along the length of belt 20. Pocket 40 includes two partitioned chambers, an upper chamber 41 and a lower chamber 51.

Not visible in FIG. 1 is a hood 60, made of collapsible waterproof material, folded in a stored position within upper chamber 41, and a skirt 70, made of collapsible waterproof material, folded in a stored position within lower chamber 51.

A golfer can quickly and easily attach cover 10 to golf bag 80 if rain is expected. Cover 10, so attached is unobtrusive and does not interfere with use of bag 80.

FIG. 2 shows cover 10 with hood 60 and skirt 70 deployed to protect bag body 82 and any clubs 99 therein from rain. Hood 60 is deployed from upper chamber 41 and includes a vertically extending opening, denoted generally as 65, for insertion and removal of clubs 99. Hood opening 65 includes a tongue 66 and a vertical slide fastener 67, 68 on each side of tongue 66. The slide fastener slider members 67S, 68S are joined by a cord 69 or the like such that both sliders 67S, 68S can be simultaneously manipulated with only one hand so that the other hand can hold a club 99. Tongue 66 includes a lower end flap 66F that extends below slide fasteners 67, 68 for covering the area over buckles 27. The end of tongue 66 includes a strip 62 of hook/loop material on the inside surface for attachment with a mating strip 63 of hook/loop material on the inside surface of hood 60, such as strip 63 shown at the base of tongue 66 or further toward belt 20. Strips 62, 63 are fastened to prevent tongue 66 from dangling when hood 60 is taken from pocket 40 and is not deployed covering clubs 99 but is simply hanging down around bag 80.

Skirt 70 is deployed from lower chamber 51 and includes a left edge 74 and a right edge 76 and fasteners, denoted generally as 79, adapted to fasten left edge 74 to said right edge 76 around bag body 82 at any of various circumferences so that various size bag bodies 82 may be enveloped. Skirt 70 may contain various openings, such as ball storage access opening and flap 71, for access to storage in bag 80. These features and their function are more fully explained with further reference to FIGS. 3–7 below.

Figure 3:
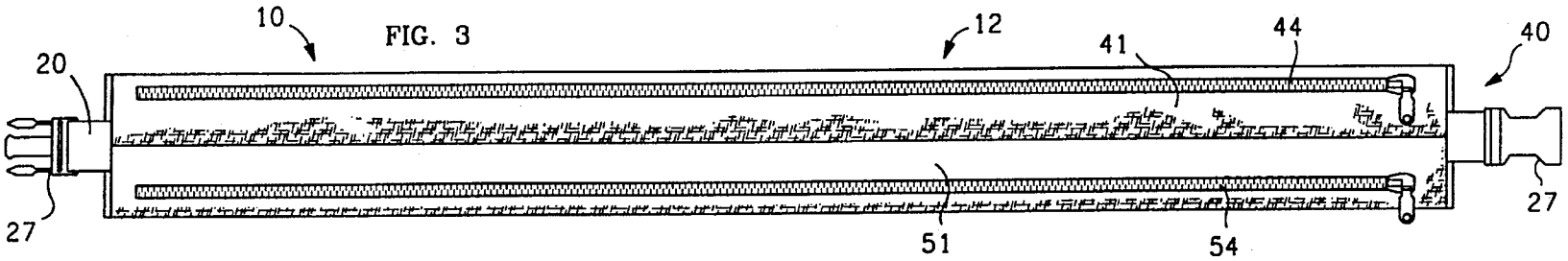
FIG. 3 is an outside plan view of the cover of FIG. 1.

FIG. 3 is a plan view of the outside 12 of cover 10 of FIG. 1, that is with hood 60 and skirt 70 in storage configuration. Pocket 40 includes upper chamber 41 that is disposed substantially along the length of belt 20 except for the buckle area. Upper chamber 41 has an opening substantially along its length with slide fastener closure 44 for insertion and extraction of hood 60. Pocket 40 includes a lower chamber 51 disposed substantially along the length of belt 20 except for the buckle area. Lower chamber 51 has an opening substantially along its length with slide fastener closure 54 for insertion and extraction of skirt 70. Belt 20 includes end buckles 27 including belt length adjustment means of conventional type on one of the buckles 27.

Figure 4:
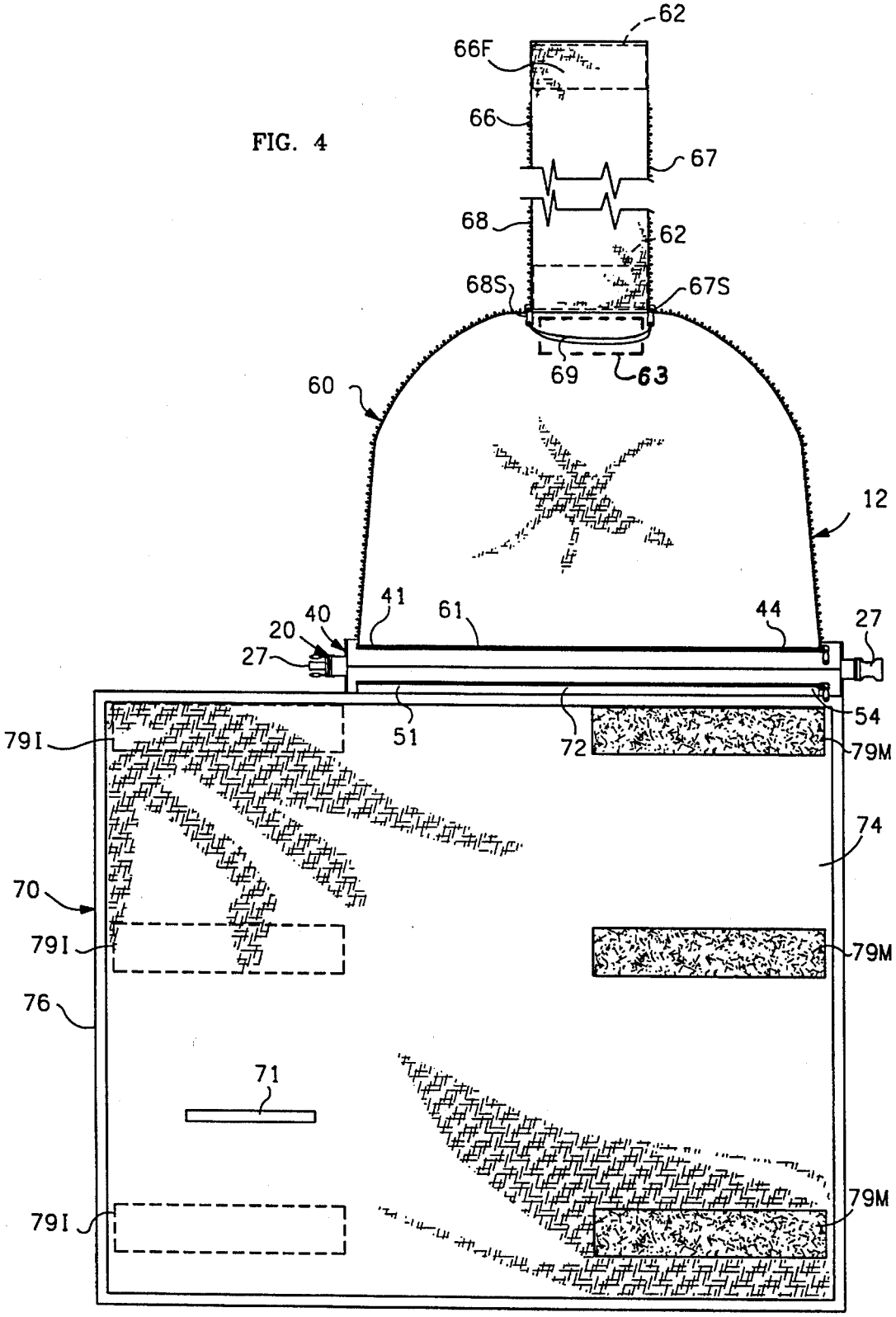
FIG. 4 is a front plan view of the outside of the cover of FIG. 2, as it would appear if deployed and laid on a flat surface.

FIG. 4 is a front plan view of the outside 12 of cover 10 of FIG. 2, approximately as it would appear with hood 60 and skirt 70 extracted from upper chamber 41 and lower chamber 51 respectively and laid open on a flat surface.

Hood 60 is made of collapsible waterproof material, such as coated nylon, vinyl or polyethylene. Hood 70 may be of transparent material so that clubs 99 may be seen and selected before opening tongue 66. Hood 60 has a bottom end 61 connected to the inside of upper chamber 41, preferably along the entire length of the chamber 41.

Skirt 70 is made of collapsible waterproof material, such as coated nylon, vinyl or polyethylene. Skirt 70 has a top end 72 connected to the inside of lower chamber 51, preferably along the entire length of the chamber 51. Skirt 70 is manipulable, i.e. unfolded, from a stored position with lower chamber 51 to the deployed position wherein it is wrapped around bag body 82 such that is substantially completely envelops the golf bag body. Fasteners 79 are adapted to adapted to fasten skirt left edge 74 to skirt right edge at a plurality of circumferences so that various size bag bodies 82 may be enveloped. In the preferred embodiment shown, fasteners 79 include a plurality of hook/loop fasteners 79I attached to the inside of one edge, such as edge 76 and mating fasteners 79M attached to the outside of the other edge, such as edge 74. Fasteners 79 have sufficient horizontal development to fasten around bag bodies 82 of various circumferences.

Figure 5:
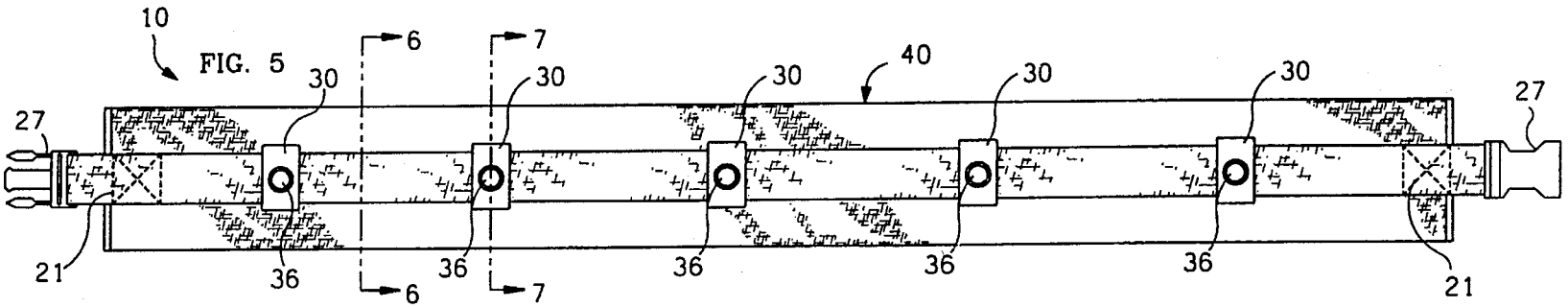
FIG. 5 is an inside plan view of the cover of FIG. 3.
Figure 6:
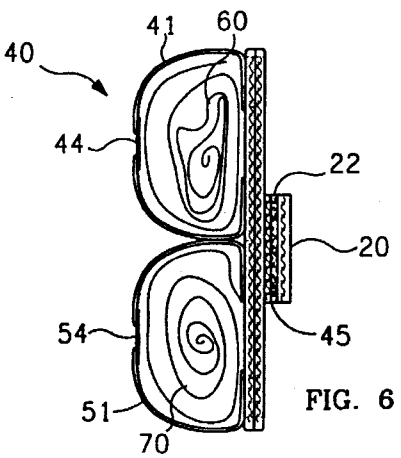
FIG. 6 is an enlarged sectional view of the cover taken on line 6—6 of FIG. 5.
Figure 7:
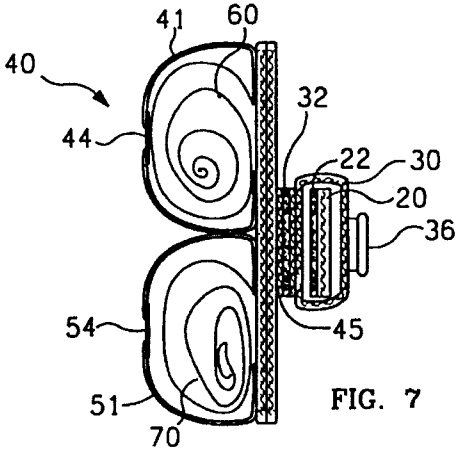
FIG. 7 is an enlarged sectional view of the cover taken on line 7—7 of FIG. 5.

FIGS. 5–7 illustrate a preferred construction regarding attachment of belt snaps 36. FIG. 5 is an inside plan view of cover 10 of FIG. 3. FIG. 6 is an enlarged sectional view of cover 10 taken on line 6—6 of FIG. 5. FIG. 7 is an enlarged sectional view of cover 10 taken on line 7—7 of FIG. 5.

Pocket 40 is fixedly attached to belt 20, such as at sewn areas 21 at each end of pocket 40. The plurality of belt snap fasteners 36 are attached to loops 30 around belt 20. As seen in FIG. 6, other than at sewn areas 21, belt 20 is attached substantially throughout its length to pocket 40 by a strip of hook/loop fastener material 45 on pocket 40 and a mating strip 22 on belt 20. As seen in FIG. 7, belt 20 can be pulled away from pocket 40. Loops 30 may then be slid along belt 20 such to adapt to their spacing to mate with bag snap fasteners 86. After spacing adjustment, material 45 is used to attach belt 20 to pocket 40 such that snap fastener loops 30 remain at the selected spacing. Mating hook/loop material 32 may also be attached to the side of loop 30 facing pocket 40. If nylon material is used for belt 20 and loop 30, it acts as a natural loop fastener material and then only a strip of hook fastener material 45 need be attached to pocket 40. Snaps 36 firmly hold cover 10 in position on bag 80. Cover 10 can be easily removed and washed.

Having described the invention, it can be seen that it provides a very convenient and effective device for protecting a golf bag from rain, sand, dust, mud or bird droppings during use.

Although a particular embodiment of the invention has been illustrated and described, various changes may be made in the form, composition, construction, and arrangement of the parts without sacrificing any of its advantages. Therefore, it is to be understood that all matter herein is to be interpreted as illustrative and not in any limiting sense, and it is intended to cover in the appended claims such modifications as come within the true spirit and scope of the invention.

I claim:

1. A rain cover for a golf bag having a bottom, a top end including a club receiving opening, and a body therebetween; said cover comprising:

a belt including:

attachment means for attachment of said belt around a golf bag adjacent the club receiving opening; and a pocket disposed substantially along the length said belt; and a hood made of collapsible water-resistant material; said hood having a bottom end connected to said belt; said hood dimensioned to be storable within said pocket; said hood manipulable from a stored position within said pocket to a deployed position substantially completely enveloping the club receiving opening and any clubs contained therein; and a skirt made of collapsible water-resistant material; said skirt having a top end connected to said belt; said skirt dimensioned to be storable simultaneously with said hood within said pocket; said skirt manipulable from a stored position within said pocket to a deployed position substantially completely enveloping the golf bag body.

2. The cover of claim 1 wherein:

said pocket comprises:

an upper chamber dimensioned for storing said hood; and a lower chamber partitioned from said upper chamber; said lower chamber dimensioned for storing said skirt; and wherein said hood in the stored position is in said upper chamber; and said skirt in the stored position is in said lower chamber.

3. The cover of claim 1 wherein:

said hood bottom end is connected to said belt along substantially the length of said belt; and said skirt top end is connected to said belt along substantially the length of said belt.

4. The cover of claim 1 wherein:

said skirt includes:

a left side; and a right side; and means forming fasteners adapted to fasten said left side to said right side at a plurality of circumferences for enclosing various size bag bodies.

5. A rain cover for a golf bag having a bottom, a top end including a club receiving opening, and a body therebetween; said cover comprising:

a belt including:

attachment means for attachment of said belt around the golf bag adjacent the club receiving opening; and means defining a pocket on said belt; and a hood made of collapsible water-resistant material; said hood having a bottom end connected to said belt; said hood dimensioned to be retained in a stored position within said pocket means; said hood manipulable from a stored position within said pocket means to a deployed position substantially completely enveloping the club receiving opening and any clubs contained therein.

6. The cover of claim 5 wherein:

said pocket means is disposed substantially along the length of said belt.

7. The cover of claim 6 wherein:

said hood bottom end is connected to said belt along substantially the length of said belt.

8. The cover of claim 5 wherein:

said belt attachment means includes a buckle portion; and said hood in the deployed position covers said belt buckle portion.

9. The cover of claim 5 wherein:

said hood includes a selectively openable opening; when said hood is in the deployed position, said opening being vertically extending such as to allow access to clubs within the bag.

10. The cover of claim 5 wherein: said hood includes:

a tongue having a base and left and right sides; said tongue being vertically extending when said hood is in the deployed position; and fastening means including slide fasteners on each said side of said tongue selectively connecting said tongue sides with the remainder of said hood such that said tongue may be opened to allow access to clubs within the bag.

11. The cover of claim 5 further including:

a skirt made of collapsible water-resistant material; said skirt having a top end connected to said belt; said skirt being dimensioned to be manipulable from a stored position within said pocket means to a deployed position substantially completely enveloping the golf bag body.

12. The cover of claim 11 wherein:

said pocket means comprises:

an upper chamber; and a lower chamber partitioned from said upper chamber; and said hood in the stored position is in said upper chamber; and said skirt in the stored position is in said lower chamber.

13. The cover of claim 11 wherein:

said skirt includes:

a left side; and a right side; and means forming fasteners adapted to fasten said left side to said right side at a plurality of circumferences so that various size bag bodies may be enveloped by said skirt.

14. A rain cover for a golf bag having a bottom, a top end including a club receiving opening and a body therebetween including a plurality of snap fasteners circumferentially spaced adjacent the club receiving opening; said cover comprising:

a belt;

a pocket attached to said belt;

a plurality of belt snap fasteners for mating attachment with the snap fasteners circumferentially spaced adjacent the club receiving opening of the bag;

attachment means for attaching said belt snap fasteners to said belt such that their spacing is adaptable to the spacing of the bag snap fasteners; and a hood made of collapsible water-resistant material; said hood having a bottom end connected to said belt; said hood dimensioned to be storable within said pocket; said hood manipulable from a stored position within said pocket to a deployed position substantially completely enveloping the club receiving opening and any clubs contained therein.

15. The cover of claim 14 wherein:

said attachment means includes:

loops attached to said snap fasteners and attached to said belt so as to be slidable along said belt.

16. The cover of claim 15 wherein said attachment means further includes:

hook and loop fastening material attached to said belt; and cooperating hook and loop fastening material attached to said pocket for mating with said hook and loop fastening material attached to said belt such that said pocket is selectively fastenable to said belt such that, in the unfastened position, said loops may move along said belt to position said belt snaps at mating positions with the bag snaps.

17. The cover of claim 15 wherein said attachment means further includes:

hook and loop fastening material attached to said loops; and cooperating hook and loop fastening material attached to said pocket for mating with said hook and loop fastening material attached to said loops such that said pocket is selectively fastenable to said loops such that, in the unfastened position, said loops may move along said belt to position said belt snaps at mating positions with the bag snaps.

18. The cover of claim 14 further including:

a skirt made of collapsible water-resistant material; said skirt having a top end connected to said belt; said skirt dimensioned to be storable within said pocket; said skirt manipulable from a stored position within said pocket to a deployed position substantially completely enveloping the golf bag body.

19. The cover of claim 18 wherein:

said pocket comprises:

an upper chamber dimensioned for storing said hood; and a lower chamber partitioned from said upper chamber; said lower chamber dimensioned for storing said skirt; and wherein said hood in the stored position is in said upper chamber; and said skirt in the stored position is in said lower chamber.

20. The cover of claim 18 wherein:

said skirt includes:

a left side; and a right side; and means forming fasteners adapted to fasten said left side to said right side at a plurality of circumferences so that various size bag bodies may be enveloped by said skirt.

21. The cover of claim 14 wherein: said hood includes:

a tongue having a base and left and right sides; said tongue being vertically extending when said hood is in the deployed position; and means forming slide fasteners on each said side of said tongue selectively connecting said tongue sides with the remainder of said hood such that said tongue may be opened to allow access to clubs within the bag.

* * * * *